United States Patent [19]

Ueno et al.

[11] Patent Number: 4,459,960

[45] Date of Patent: Jul. 17, 1984

[54] SPLIT ENGINE

[75] Inventors: Makoto Ueno, Shizuoka; Kohei Hori, Susono, both of Japan

[73] Assignee: Toyota Jidosha Kabushiki Kaisha, Toyota, Japan

[21] Appl. No.: 465,257

[22] Filed: Feb. 9, 1983

[30] Foreign Application Priority Data

Oct. 22, 1982 [JP] Japan ..... 57-184435

[51] Int. Cl.[3] ..... F02D 17/00; F02D 17/02; F02B 77/00

[52] U.S. Cl. ..... 123/481; 123/198 F

[58] Field of Search ..... 123/481, 198 F, 568, 123/580; 60/276, 285

[56] References Cited

U.S. PATENT DOCUMENTS

| | | | |
|---|---|---|---|
| 4,201,180 | 5/1980 | Iizuka | 123/481 |
| 4,337,740 | 7/1982 | Sugasawa et al. | 123/481 |
| 4,344,393 | 8/1982 | Elab et al. | 123/481 |
| 4,354,471 | 10/1982 | Sugasawa et al. | 123/481 |
| 4,365,597 | 12/1982 | Iizuka et al. | 123/481 |
| 4,391,240 | 7/1983 | Sugasawa et al. | 123/481 |
| 4,411,228 | 10/1983 | Sugasawa | 123/481 |

*Primary Examiner*—Raymond A. Nelli

*Attorney, Agent, or Firm*—Finnegan, Henderson, Farabow, Garrett, Dunner

[57] ABSTRACT

A split engine comprising a plurality of cylinders divided into a first cylinder group and a second cylinder group. The second cylinder group is connected to the outside air via a second surge tank. The first cylinder group is connected to the second surge tank via a first surge tank. A shut-off valve is arranged in the connecting portion of the first surge tank and the second surge tank. The supply of fuel into both of the cylinder groups is stopped when a predetermined time period has elapsed after the decelerating operation is started. Then, the shut-off valve opens when a predetermined time period has elapsed after the supply of fuel is stopped.

20 Claims, 10 Drawing Figures

| Fig. 4A | Fig. 4B |
|---|---|

SPLIT ENGINE

BACKGROUND OF THE INVENTION

The present invention relates to a split engine.

In an internal-combustion engine in which the load of the engine is controlled by a throttle valve, a specific fuel consumption deteriorates as the degree of opening of the throttle valve is reduced. Consequently, in order to improve the specific fuel consumption, a split engine as disclosed in Japanese Unexamined Patent Publication (Kokai) No. 55-69736 has been devised in which, when the engine is operating under a light load, part of the cylinders of the engine are not fired while the remaining cylinders operate under a heavy load. As is illustrated in FIG. 1, in this type of engine, the cylinders are divided into a first cylinder group A and a second cylinder group B, and a first intake manifold 1 and a second intake manifold 2 are connected to the first cylinder group A and the second cylinder group B, respectively. The first intake manifold 1 and the second intake manifold 2 are connected to the outside air via a common throttle valve 3, and a shut-off valve 4 is arranged in the air inlet of the first intake manifold 1. The first intake manifold 1 and an exhaust manifold 5 are interconnected to each other via an exhaust-gas recirculation passage 6, and a recirculation control valve 7 is arranged in the exhaust-gas recirculation passage 6. In the split engine, when the engine is operating under a light load, the injection of fuel by fuel injectors 8 is stopped, and the shut-off valve 4 is closed. In addition, the recirculation control valve 7 is open, and the cylinders of the second cylinder group B operate under a heavy load. Contrary to this, when the engine is operating under a heavy load, the shut-off valve 4 is open, and the recirculation control valve 7 is closed. In addition, fuel is injected by all of the fuel injectors 8 and 9, and, thus, all of the cylinders are fired.

As mentioned above, when the engine is operating under a light load, the shut-off valve 4 is closed, and the recirculation control valve 7 is open. As a result, since the exhaust gas is recirculated into the first cylinder group A via the exhaust-gas recirculation passage 6, it is possible to prevent pumping loss in the first cylinder group A from occurring. In addition, at this time, since the cylinders of the second cylinder group B operate under a heavy load, it is possible to improve the specific fuel consumption.

In such a split engine, if the engine is decelerated when the engine is operating under a heavy load, since the engine load is reduced, the shut-off valve 4 closes. In addition, if the engine is decelerated when the engine is operating under a light load, the shut-off valve 4 remains close. However, if the shut-off valve 4 closes when the engine is decelerated, since the recirculation control valve 7 opens, the exhaust gas is continuously recirculated into the first cylinder group A. Consequently, at this time, even if the injection of fuel into both the cylinder groups A and B is stopped, the first cylinder group A does not effect the engine braking opeation and, thus, a problem occurs in that a good engine braking operation cannot be obtained.

SUMMARY OF THE INVENTION

An object of the present invention is to provide a split engine capable of obtaining a good engine braking operation by stopping the supply of fuel into all the cylinders and by opening the shut-off valve when the engine is decelerated.

According to the present invention, there is provided a split engine having a plurality of cylinders which are divided into a first cylinder group and a second cylinder group, said engine comprising: a first intake passage having an inlet and an outlet connected to said first cylinder group; a second intake passage having an inlet and an outlet connected to said second cylinder group, the inlet of said first intake passage being connected to said second intake passage and the inlet of said second intake passage being open to the outside air; an exhaust passage connected to said first cylinder group; a manually operated throttle valve arranged in the inlet of said second intake passage; first detecting means for detecting the level of the load of the engine and for producing an output signal representing the level of the load of the engine; second detecting means for detecting the decelerating operation of the engine and for producing an output signal indicating that the decelerating operation is carried out; electronic control means for producing control signals in response to the output signals of said first detecting means and said second detecting means, fuel supply means, actuated in response to a control signal of said electronic control means, for feeding fuel into only said second cylinder group when the level of the load of the engine is lower than a predetermined level and for feeding fuel into both of said cylinder groups when the level of the load of the engine is higher than the predetermined level, said fuel supply means stopping the supply of fuel into both of said cylinder groups when a predetermined first time period has elapsed after the decelerating operation of the engine is started; an exhaust-gas recirculation passage interconnecting said exhaust passage to said first intake passage; a recirculation control valve, arranged in said exhaust-gas recirculation passage, for controlling the flow area of said exhaust-gas recirculation passage; first actuating means operated in response to a control signal of said electronic control means and opening said recirculation control valve when the level of the load of the engine becomes lower than the predetermined level, said first actuating means closing said recirculation control valve independently of the level of the load of the engine when a predetermined second time period has elapsed after the decelerating operation of the engine is started; a shut-off valve, arranged in the inlet of said first intake passage, for controlling the flow area of the inlet of said first intake passage; and second actuating means operated in response to a control signal of said electronic control means and opening said shut-off valve when the level of the load of the engine becomes higher than the predetermined level, said second actuating means opening said shut-off valve independently of the level of the load of the engine when the predetermined second time period has elapsed after the decelerating operation of the engine is started.

The present invention may be more fully understood from the description of a preferred embodiment of the invention, set forth below, together with the accompanying drawings.

DESCRIPTION OF THE PREFERRED EMBODIMENT

Figure 2:
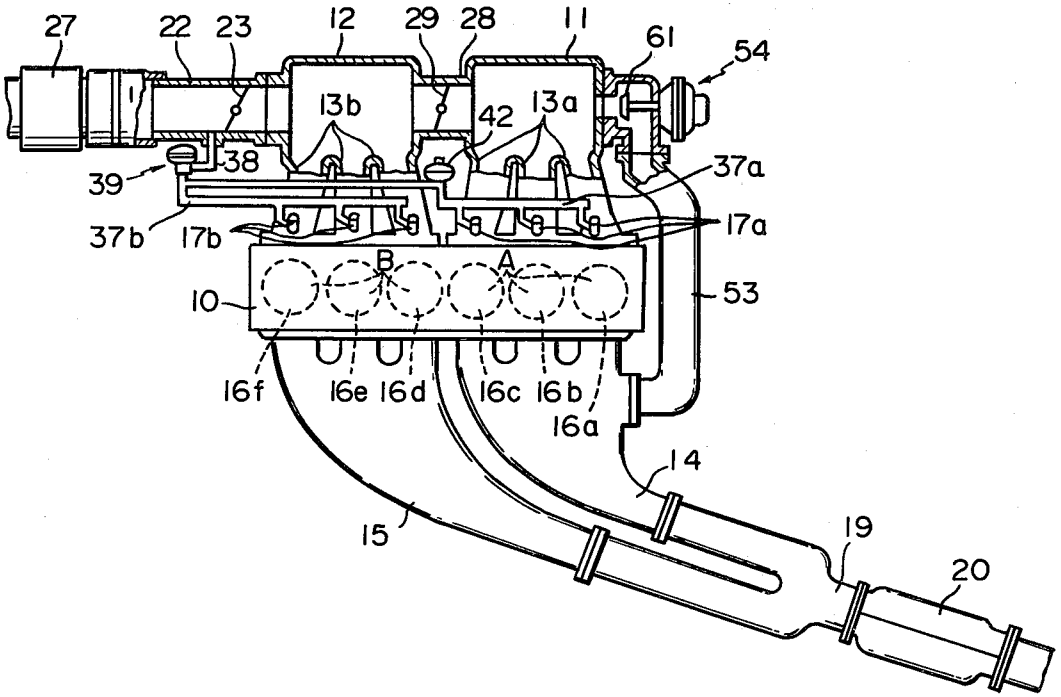
FIG. 2 is a plan view of an engine according to the present invention.

Referring to FIG. 2, reference numeral 10 designates an engine body, 11 a first surge tank, 12 a second surge tank, and 13*a* separate first pipes connected to the first surge tank 11, 13*b* designates separate second pipes connected to the second surge tank 12, 14 a first exhaust manifold, and 15 a second exhaust manifold; and 16*a*, 16*b*, 16*c*, 16*d*, 16*e*, and 16*f* designate a No. 1 cylinder, a No. 2 cylinder, a No. 3 cylinder, a No. 4 cylinder, a No. 5 cylinder, and a No. 6 cylinder, respectively. The cylinders 16*a*, 16*b*, 16*c*, 16*d*, 16*e*, and 16*f* are divided into a first cylinder group A consisting of the cylinders 16*a*, 16*b*, and 16*c* and a second cylinder group B consisting of the cylinders 16*d*, 16*e*, and 16*f*.

As is illustrated in FIG. 2, the first surge tank 11 and the first exhaust manifold 14 are connected to the first cylinder group A, and the second surge tank 12 and the second exhaust manifold 15 are connected to the second cylinder group B.

Figure 3:
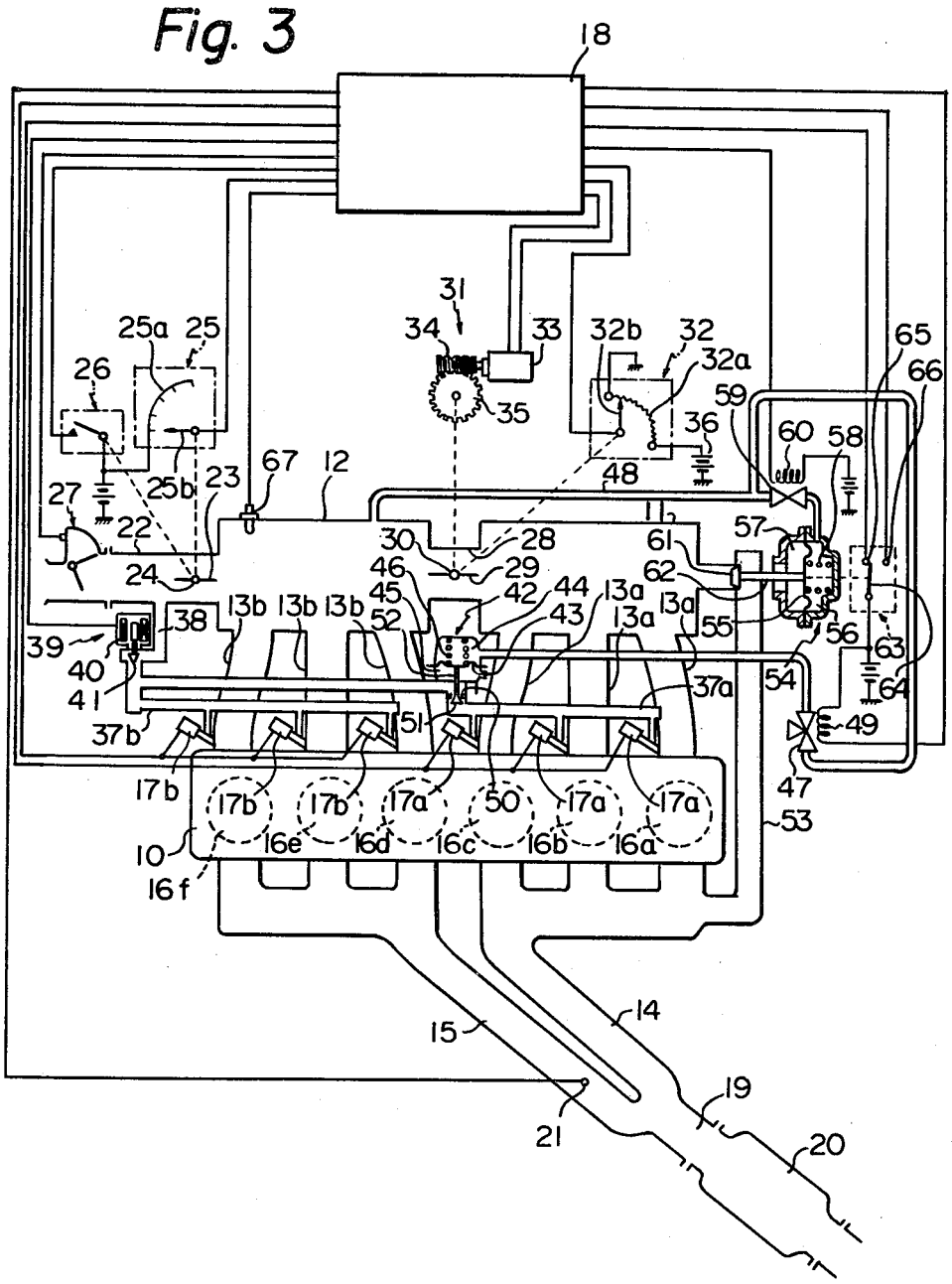
FIG. 3 is a schematically illustrated plan view of the engine illustrated in FIG. 2.

As is illustrated in FIGS. 2 and 3, fuel injectors 17*a* are mounted on first pipes 13*a* of the first surge tank 11, and fuel injectors 17*b* are mounted on second pipes 13*b* of the second surge tank 12. The solenoids of the fuel injectors 17*a* and 17*b* are connected to an electronic control unit 18. The first exhaust manifold 14 and the second exhaust manifold 15 are joined to each other and are connected to a single collection pipe 19. The outlet of the collection pipe 19 is connected to a three-way catalytic converter 20.

As is illustrated in FIG. 3, an oxygen concentration detector 21 (hereinafter referred to as an $O_2$ sensor) is arranged in the second exhaust manifold 15 and is connected to the electronic control unit 18. An intake duct 22 is attached to the second surge tank 12, and a throttle valve 23 is arranged in the intake duct 22. The throttle valve 23 is connected to the accelerator (not shown). A throttle sensor 25 and an idle switch 26 are connected to a valve shaft 24 of the throttle valve 23. The throttle sensor 25 comprises a comb-shaped stationary terminal 25*a* and a rotary terminal 25*b*, which is rotatable together with the throttle valve 23. The throttle sensor 25 produces an output signal every each time the rotary terminal 25*b* faces one of the teeth of the comb-shaped stationary terminal 25*a*. Consequently, as the opening speed or the closing speed of the throttle valve 23 is increased, the time interval of the generation of the output signals of the throttle sensor 25 becomes short, and, thus, the opening speed and the closing speed of the throttle valve 23 can be calculated from the output signals of the throttle sensor 25. The idle switch 26 is turned ON when the throttle valve 23 is at idle. The throttle sensor 25 and the idle switch 26 are connected to the electronic control unit 18. An airflow meter 27 is attached to the inlet of the intake duct 22 and is connected to the electronic control unit 18.

The first surge tank 11 and the second surge tank 12 are interconnected to each other via a connecting pipe 28, which is formed in one piece thereon, and a shut-off valve 29 is arranged in the connecting pipe 28. The valve shaft 30 of the shut-off valve 29 is connected, on the one hand, to a drive apparatus 31 and, on the other hand, to a valve position sensor 32. The drive apparatus 31 comprises a DC motor 33, a worm gear 34 fixed to the drive shaft of the DC motor 33, and a worm wheel 35 engaging with the worm gear 34 and fixed to the valve shaft 30 of the shut-off valve 29. Consequently, it is understood that when the DC motor 33 is operated, the shut-off valve 29 is rotated.

The valve position sensor 32 comprises a stationary resistor 32*a* and a movable contact 32*b*, which rotates together with the shut-off valve 29 while contacting the stationary resistor 32*a*. One end of the stationary resistor 32*a* is connected to a power source 36, and the other end of the stationary resistor 32*a* is grounded. Consequently, it is understood that the voltage, which is proportional to the degree of opening of the shut-off valve 29, is produced at the movable contact 32*b*. The DC motor 33 and the valve position sensor 32 are connected to the electronic control unit 18.

As illustrated in FIGS. 2 and 3, an auxiliary air supply pipe 38 is branched off from the intake duct 22 located upstream of the shut-off valve 23, and a first assist air conduit 37*a* and a second assist air conduit 37*b* are branched from the auxiliary air supply pipe 38. The first assist air conduit 39*a* is connected to the fuel injector 17*a* of the first cylinder group A, and the second assist air conduit 37*b* is connected to the fuel injectors 17*b* of the second cylinder group B.

Figure 1:
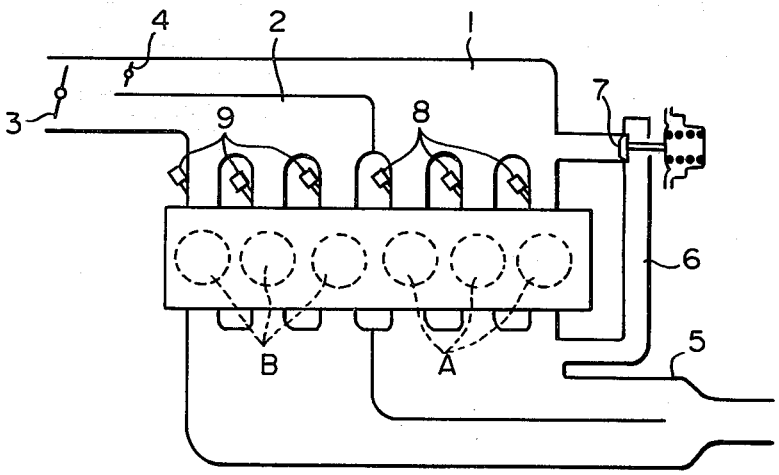
Fig. 1 PRIOR ART
FIG. 1 is a schematically illustrated plan view of a prior art engine.
Figure 7:
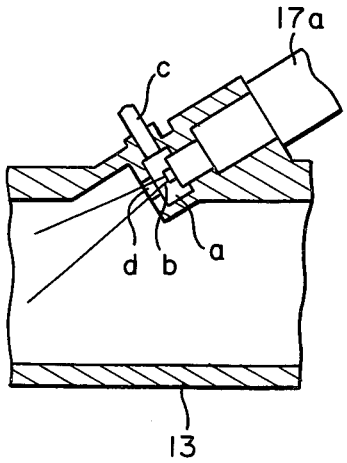
FIG. 7 is a cross-sectional side view of the first pipe of the first surge tank.

FIG. 7 illustrates a cross-sectional side view of one of the first pipes 13*a* of the first cylinder group A. Referring to FIG. 7, a cylindrical assist air chamber a is formed in the upper wall of the first pipe 13*a*, and the nozzle b of the fuel injector 17*a* is arranged in the assist air chamber a. The assist air chamber a is connected to, on one hand, to the first assist air conduit 37*a* via a branch pipe C and, on the other hand, to the interior of the first pipe 13*a* via an opening d. As illustrated in FIG. 7, fuel is injected into the interior of the first pipe 13*a* from the nozzle b of the fuel injector 17*a* through the opening d. At this time, if air is fed into the assist air chamber a from the branch pipe C, the air flows into the interior of the first pipe 13*a* from the opening d. Consequently, at this time, the air, flowing out from the opening d, provides the shearing force for fuel droplets and, thus, the atomization of fuel is promoted. The assist air chambers of the fuel injector 17*b* of the second cylinder group B have a construction which is the same as that of the fuel injector 17*a* and, therefore, the description, regarding the construction of the assist air chambers of the fuel injectors 17*b*, is omitted here.

As illustrated in FIG. 3, a valve unit 39 for controlling the idle speed of the engine is arranged in the auxiliary air supply pipe 38. The valve unit 39 comprises a stepping motor 40 actuated in response to the output signal of the electronic control unit 18 and a flow-control valve 41 is driven by the stepping motor 40. When the engine is idling, the amount of air flowing within the auxiliary air supply pipe 38 is controlled by the flow-control valve 41 so that the idle speed of the engine is kept constant. An assist air control valve apparatus 42 is arranged in the first assist air conduit 37*a*. The assist air control valve apparatus 42 comprises a vacuum chamber 44 and an atmospheric pressure chamber 45 which are separated by a diaphragm 43, and a compression spring 46 for biasing the diaphragm 43 is inserted in the vacuum chamber 44. The vacuum chamber 44 is connected to the second surge tank 12 via a first electromagnetic valve 47 and a vacuum conduit 48. In addition, the solenoid 49 of the first electromagnetic valve 47 is connected to the electronic control unit 18. A valve port 50 is formed in the first assist air conduit 37*a*, and a valve body 51 for controlling the opening operation of the valve port 50 is arranged in the first assist air conduit 37*a*. The valve body 51 is connected to the diaphragm 43 via a valve rod 52.

The first exhaust manifold 14 and the first surge tank 11 are interconnected to each other via an exhaust-gas recirculation passage 53, and a recirculation control valve 54 is arranged in the exhaust-gas recirculation passage 53. The recirculation control valve 54 comprises a vacuum chamber 56 and an atmospheric pressure chamber 57, which are separated by a diaphragm 55, and a compression spring 58 for biasing the diaphragm 55 is inserted in the vacuum chamber 56. The vacuum chamber 56 is connected to the second surge tank 12 via a second electromagnetic valve 59 and the vacuum conduit 48, and the solenoid 60 of the second electromagnetic valve 59 is connected to the electronic control unit 18. A valve body 61 for controlling the flow area of the exhaust-gas recirculation passage 53 is arranged in the exhaust-gas recirculation passage 53 and is connected to the diaphragm 55 via a valve rod 62. In addition, the recirculation control valve 54 is provided with a valve position switch 63. The valve position switch 63 comprises a movable contact 64 connected to the diaphragm 55 and actuated by it and a pair of stationary contacts 65 and 66 which are able to contact the movable contact 64. The stationary contacts 65 and 66 are connected to the electronic control unit 18. The movable contact 64 is connected to the stationary contact 65 when the valve body 61 closes and is connected to the stationary contact 66 when the valve body 61 opens.

As is illustrated in FIG. 3, a vacuum sensor 67 for detecting the level of the load of the engine is arranged in the second surge tank 12 and is connected to the electronic control unit 18. In addition, in order to detect the engine speed, a speed sensor 72 (FIG. 4) is mounted on the engine body 10.

Figures 4, 4A:
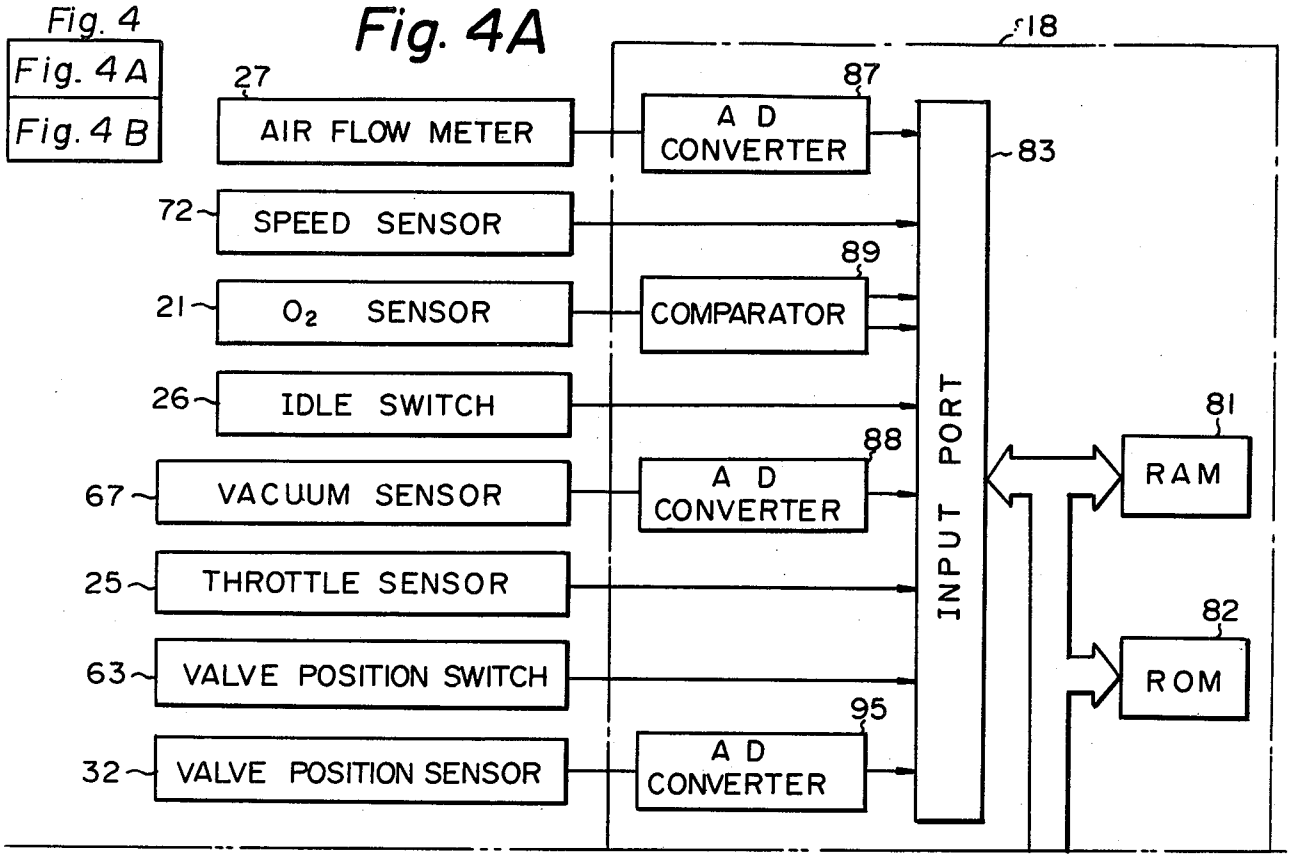
FIGS. 4*a* and 4*b* are a circuit diagram of the electronic control unit illustrated in FIG. 3.
Figure 4B:
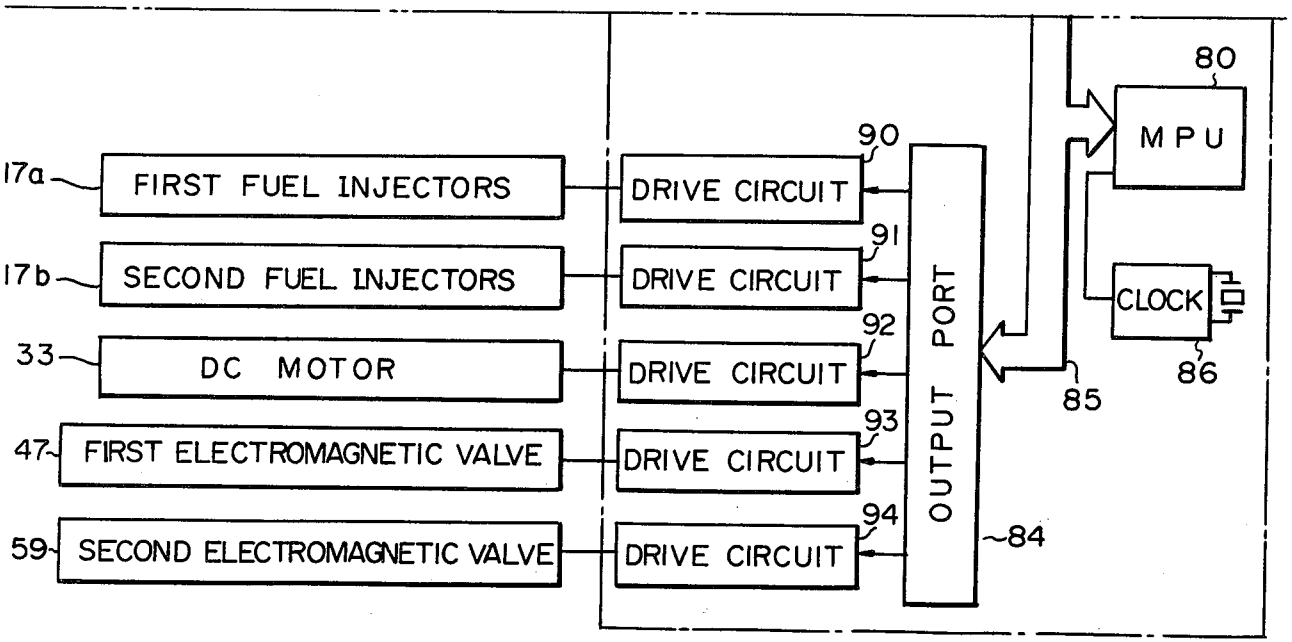

FIG. 4 illustrates the electronic control unit 18. Referring to FIG. 4, the electronic control unit 18 is constructed as a digital computer and comprises a microprocessing unit (MPU) 80 for carrying out arithmetic and logic processing, a random-access memory (RAM) 81, a read-only memory (ROM) 82 for storing a predetermined control program and an arithmetic constant therein, an input port 83, and an output port 84. The MPU 80, the RAM 81, the ROM 82, the input port 83, and the output port 84 are interconnected to each other via a bidirectional bus 85. In addition, the electronic control unit 18 comprises a clock generator 86 for generating various clock signals.

As is illustrated in FIG. 4, the speed sensor 72, the idle switch 26, the throttle sensor 25, and the valve position switch 63 are connected to the input port 83. The airflow meter 27, the vacuum sensor 67 and the valve position sensor 32 are connected to the input port 83 via corresponding AD converters 87, 88 and 95, and the $O_2$ sensor 21 is connected to the input port 83 via a comparator 89.

The airflow meter 27 produces an output voltage which is proportional to the amount of air fed into the intake duct 22. The output voltage of the airflow meter 27 is converted into the corresponding binary code in the AD converter 87 and then the binary code is input into the MPU 80 via the input port 83 and the bus 85. The speed sensor 72 produces continuous pulses at a frequency which is proportional to the engine speed, and the continuous pulses are input into the MMPU 80 via the input port 83 and the bus 85. The $O_2$ sensor 21 produces an output voltage of about 0.1 volts when the air-fuel ratio of the fuel mixture fed into the second cylinder group B becomes larger than the stoichiometric air-fuel ratio and produces an output voltage of about 0.9 volts when the air-fuel ratio of the fuel mixture fed into the second cylinder group B becomes smaller than the stoichiometric air-fuel ratio.

The output voltage of the $O_2$ sensor 21 is compared with a reference voltage of about 0.5 volts in the comparator 89. At this time, if the air-fuel ratio of the fuel mixture is larger than the stoichiometric air-fuel ratio, an output signal is produced at one of the output terminals of the comparator 89, and if the air-fuel ratio of the fuel mixture is smaller than the stoichiometric air-fuel ratio, an output signal is produced at the other output terminal of the comparator 89. The output signal of the comparator 89 is input into the MPU 80 via the input port 83 and the bus 85.

The vacuum sensor 67 produces an output voltage which is proportional to the level of vacuum in the second surge tank 12. The output voltage of the vacuum sensor 67 is converted to the corresponding binary code in the AD converter 95 and then the binary code is input into the MPU 80 via the input port 83 and the bus 85. In addition, the output signals of the idle switch 26, the throttle sensor 25, and the valve position switch 63 are input into the MPU 80 via the input port 83 and the bus 85.

The first fuel injectors 17*a*, the second fuel injectors 17*b*, the DC motor 33, the first electromagnetic valve 47, and the second electromagnetic valve 59 are connected to the output port 84 via corresponding drive circuits 90, 91, 92, 93, and 94. Data for actuating the first fuel injectors 17*a*, the second fuel injectors 17*b*, the DC motor 33, the first electromagnetic valve 47, and the second electromagnetic vavle 59 is written into the output port 84.

Figure 5:
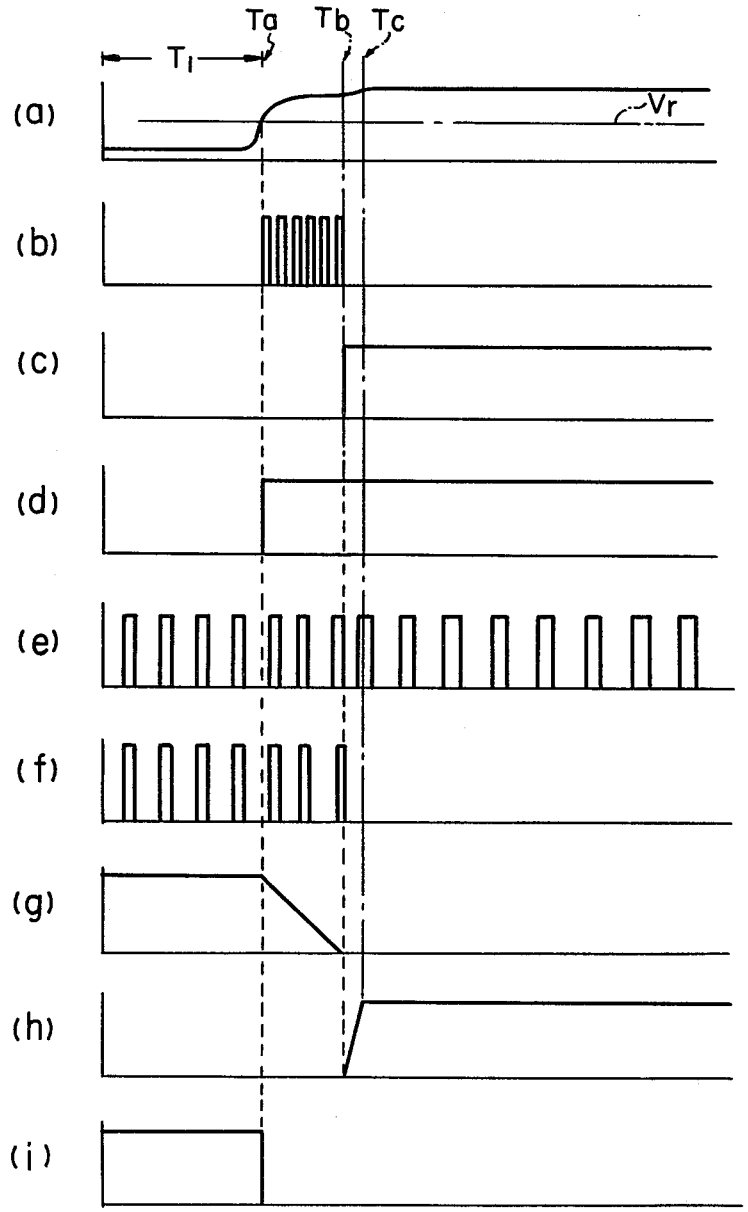
FIG. 5 is a diagram illustrating the control method according to the present invention.
Figure 6:
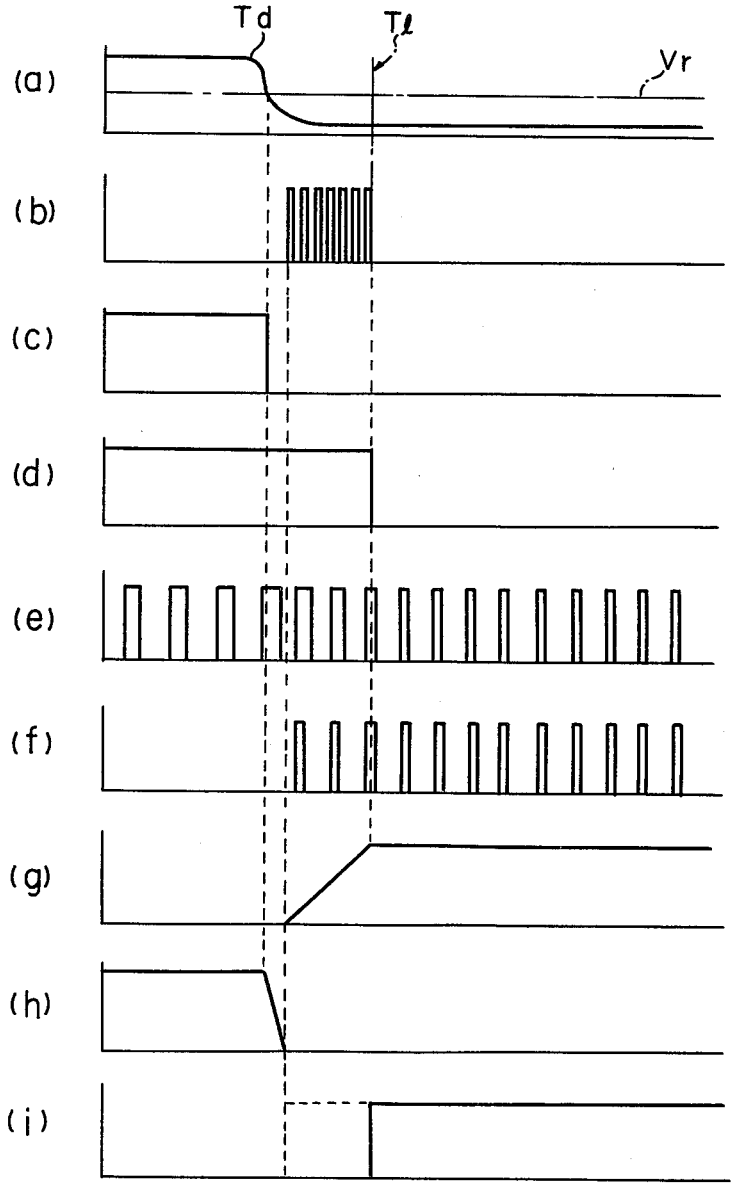
FIG. 6 is a diagram also illustrating the control method according to the present invention.

FIGS. 5 and 6 illustrate the basic operation of the split engine according to the present invention. The basic operation of the split engine is hereinafter described.

In FIGS. 5 and 6:

(a) indicates the output voltage of the vacuum sensor 67.
(b) indicates a drive pulse supplied to the DC motor 33.
(c) indicates a control voltage supplied to the solenoid 60 of the second electromagnetic valve 59.
(d) indicates a control voltage supplied to the solenoid 49 of the first electromagnetic valve 47.
(e) indicates a control pulse supplied to the fuel injectors 17*b* of the second cylinder group B.
(f) indicates a control pulse supplied to the fuel injectors 17*a* of the first cylinder group A.
(g) indicates the degree of opening of the shut-off valve 29.

(h) indicates the degree of opening of the valve body 61 of the recirculation control valve 54.

(i) indicates the degree of opening of the valve body 51 of the assist air control valve apparatus 42.

FIG. 5 illustrates a case wherein the operating state of the engine is changed from a heavy load to a light load, and FIG. 6 illustrates a case wherein the operating state of the engine is changed from a light load to a heavy load.

In FIG. 5, section $T_1$ indicates a state where the output voltage of the vacuum sensor 67 is low, that is, the engine is operating under a heavy load. At this time, the DC motor 33 is not driven, as is illustrated in FIG. 5 (*b*), and the shut-off valve 29 is in the wide open position, as is illustrated in FIG. 5 (*g*). In addition, at this time, the solenoid 60 of the second electromagnetic valve 59 is de-energized, as is illustrated in FIG. 5 (*c*), and, thus, the vacuum chamber 56 of the recirculation control valve 54 is open to the atmosphere via the second electromagnetic valve 59. As a result, the diaphragm 55 moves towards the atmospheric pressure chamber 57, and, thus, the valve body 61 shuts off the exhaust-gas recirculation passage 53, as is illustrated in FIG. 5 (*h*). Furthermore, at this time, the solenoid 49 of the first electromagnetic valve 47 is de-energized, as is illustrated in FIG. 5 (*d*), and, thus, the vacuum chamber 44 of the assist air control valve apparatus 42 is open to the atmosphere via the first electromagnetic valve 47. As a result, the diaphragm 43 moves towards the atmospheric pressure chamber 45, and, thus, the valve body 51 of the assist air control valve device 42 opens the valve port 50 to the maximum extent, as is illustrated in FIG. 5(*i*).

On the other hand, in section $T_1$ of FIG. 5, the engine speed is calculated in the MPU 80 (FIG. 4) from the output pulse of the speed sensor 72, and, in addition, the basic fuel injection period is calculated in the MPU 80 from the calculated engine speed and the output signal of the airflow meter 27. In a case wherein the three-way catalytic converter 20 is used, as is illustrated in FIG. 3, when the air-fuel ratio of the fuel mixture fed into the second cylinder group B becomes equal to the stoichiometric air-fuel ratio, the purifying efficiency of the three-way catalytic converter 20 reaches a maximum. Consequently, in the MPU 80, the actual fuel injection period is obtained by correcting the basic fuel injection period on the basis of the output signal of the $O_2$ sensor 21 so that the air-fuel ratio of the fuel mixture fed into the second cylinder group B approaches the stoichiometric air-fuel ratio. Data indicating the actual fuel injection period is written into the output port 84, and the control pulse, corresponding to the data and illustrated in FIG. 5(*e*) and (*f*), is supplied to the fuel injectors 17*a* of the first cylinder group A and the fuel injectors 17*b* of the second cylinder group B. Consequently, when the engine is operating under a heavy load, fuel is injected from all of the fuel injectors 17*a* and 17*b*.

If the operating state of the engine is changed from a heavy load to a light load at the time $T_a$ in FIG. 5, the output voltage of the vacuum sensor 67 is abruptly increased, as is illustrated in FIG. 5(*a*). In the MPU 80, when the output voltage of the vacuum sensor 67 exceeds the reference voltage $V_r$ (FIG. 5(*a*)), it is determined that the engine is operating under a light load. As a result, a drive signal, that is, the continuous pulses illustrated in FIG. 5(*b*), is supplied to the DC motor 33. At this time, the DC motor 33 rotates at a speed which is proportional to the mean voltage of the continuous pulses. As a result, the shut-off valve 29 is gradually opened, as is illustrated in FIG. 5(*g*). Then the shut-off valve 29 closes at the time $T_b$ in FIG. 5. In addition, if the operating state of the engine is changed from a heavy load to a light load at the time $T_a$ in FIG. 5, since the solenoid 49 of the first electromagnetic valve 47 is energized, the vacuum chamber 44 of the assist air control valve apparatus 42 is connected to the second surge tank 12 via the vacuum conduit 48. As a result of this, the diaphragm 43 moves towards the vacuum chamber 44 and, thus, the valve body 51 closes the valve port 50 as illustrated in FIG. 5(*i*).

Then, at the time $T_b$ of FIG. 5, in the MPU 80, if it is determined, on the basis of the output signal of the valve position sensor 32, that the shut-off valve 29 is closed, various kinds of data, such as data for stopping the injection of fuel by the first fuel injectors 17*a*, data for increasing the amount of fuel injected by the second fuel injectors 17*b*, and data for energizing the solenoid 60 of the second electromagnetic valve 59, is written into the output port 84. As a result, at the time $T_b$ in FIG. 5, the amount of fuel injected by the fuel injectors 17*b* of the second cylinder group B is increased, as is illustrated in FIG. 5(*e*), and the injection of fuel by the fuel injectors 17*a* of the first cylinder group A is stopped, as is illustrated in FIG. 5(*f*). In addition, since the solenoid 60 of the second electromagnetic valve 59 is energized, as mentioned above, the vacuum chamber 56 of the recirculation control valve 54 is connected to the second surge tank 12 via the vacuum conduit 48. As a result, since the diaphragm 55 moves towards the vacuum chamber 56, the valve body 61 opens the exhaust-gas recirculation passage 53. This valve body 61 opens to the maximum extent at the time $T_c$ in FIG. 5.

In FIG. 6, the time $T_d$ indicates the time at which the operating state of the engine is changed from a light load to a heavy load. At this time, since the solenoid 60 of the second electromagnetic valve 59 is de-energized, as is illustrated in FIG. 6(*c*), the valve body 61 of the recirculation control valve 54 shuts off the exhaust-gas recirculation passage 53, as is illustrated in FIG. 6(*h*). When the valve body 61 completely shuts off the exhaust-gas recirculation passage 53 and, thus, the movable contact 64 of the valve position switch 63 comes into contact with the stationary contact 65, various types of data, such as data for starting the injection of fuel by the first fuel injectors 17*a*, as is illustrated in FIG. 6(*f*), and data for driving the DC motor 33, as is illustrated in FIGS. 6(*b*), is written into the output port 84. Consequently , when the valve body 61 of the recirculation control valve 54 completely shuts off the exhaust-gas recirculation passage 53, the injection of fuel by the first fuel injectors 17*a* is started, as is illustrated in FIG. 6(*f*). In addition, at this time, the shut-off valve 29 gradually opens, as is illustrated in FIG. 6(*g*), and then opens to the maximum extent at the time $t_e$ in FIG. 6. At the time $t_e$, in the MPU 80, if it is determined, on the basis of the output signal of the valve position sensor 32, that the shut-off valve 29 opens to the maximum extent, data for de-energizing the solenoid 49 of the first electromagnetic vlave 47 is written in the output port 84. As a result of this, the valve body 51 of the assist air control valve apparatus 42 opens the valve port 50, as is illustrated in FIG. 6(*i*).

As is understood from FIGS. 5 and 6, when the valve body 61 of the recirculation control valve 54 opens the exhaust-gas recirculation passage 53, the valve body 51 of the assist air control valve apparatus 42 closes the valve port 50. Consequently, there is no danger of the exhaust gas, which flows into the first surge tank 11 from the exhaust-gas recirculation passage 53, flowing into the second pipes 13*b* of the second surge tank 12 via the first assist air conduit 37*a* and the second assist air conduit 37*b*. In addition, when the degree of opening of the shut-off valve 29 is small in a state where the opening operation or the closing operation of the shut-off valve 29 is carried out, the level of vacuum produced in the first surge tank 11 becomes greater than that of vacuum produced in the second surge tank 12. Consequently, if the valve body 51 of the assist air control valve apparatus 42 opens the valve port 50 when the opening operation or the closing operation of the shut-off valve 26 is carried out, a part of fuel injected from the fuel injector 17*b* of the second cylinder group B is sucked into the first pipes 13*a* of the first cylinder group A via the second assist air conduit 37*b* and the first assist air conduit 37*a*. This results in a problem in that the fuel mixture, fed into the first cylinder group A, becomes rich, and that the fuel mixture, fed into the second cylinder group B, becomes lean. However, in the present invention, since the valve body 51 of the assist air control valve apparatus 42 closes the valve port 50 when the opening operating or the closing operation of the shut-off valve 29 is carried out, there is no danger that fuel, injected from the fuel injectors 17*b*, is sucked into the first pipes 13*a* of the first surge tank 11. As a result of this, in the present invention, it is possible to feed the fuel mixture, having an optimum air-fuel ratio, into both the first cylinder group A and the second cylinder group B even when the opening operation or the closing operation of the shut-off valve 29 is carried out.

Figure 8:
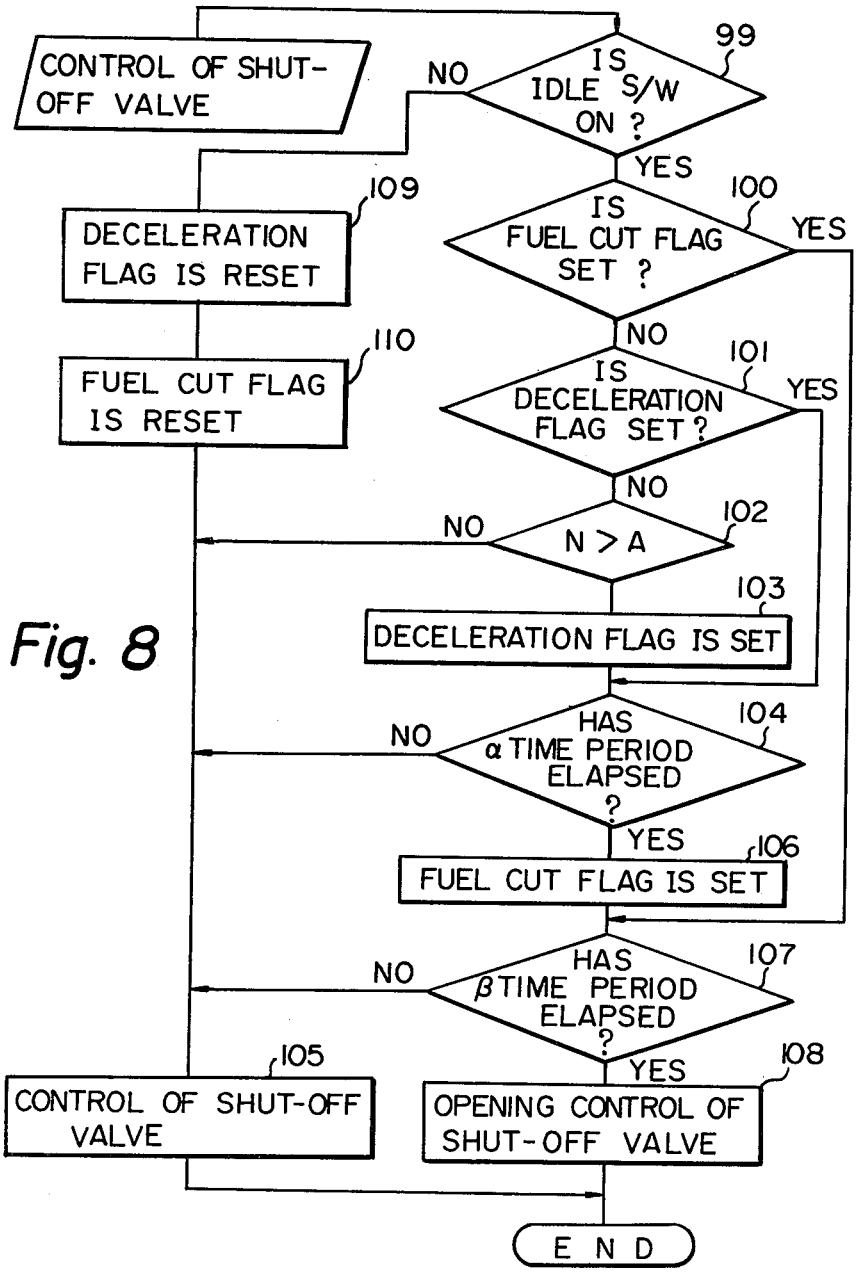
FIG. 8 is a flow chart illustrating the control of the shut-off valve.
Figure 9:
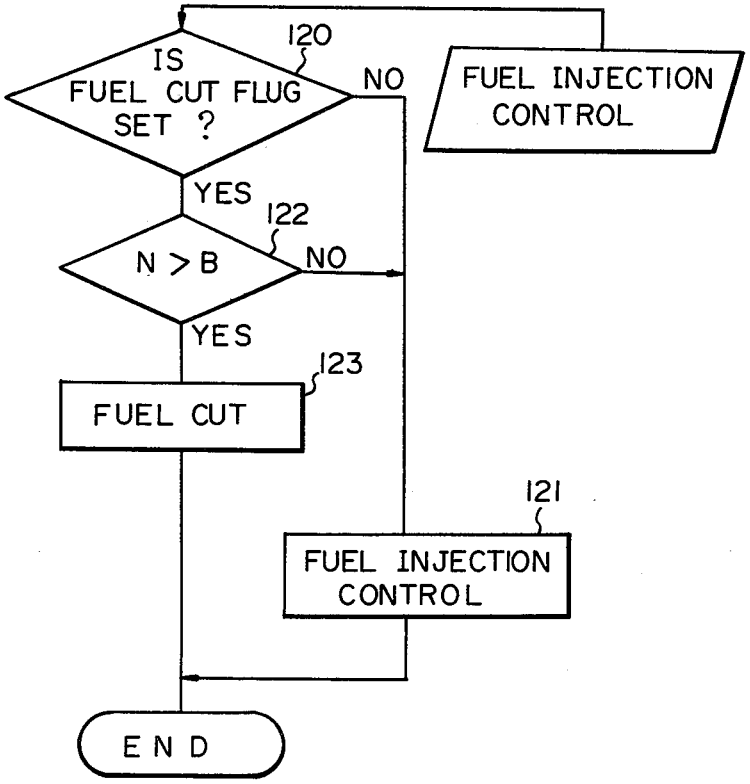
FIG. 9 is a flow chart illustrating the control of the injection of fuel.

The operation of the electronic control unit 18, which is carried out when the engine is decelerated, is described with reference to FIGS. 8 and 9. FIG. 8 illustrates the processing routine for controlling the shut-off valve 29, and FIG. 9 illustrates the processing routine for controlling the injection of fuel. Each of the processing routines is processed by sequential interruptions which are executed periodically at predetermined times. Referring to FIG. 8, first, in step 99, it is determined whether or not the idle switch 26 is on. When the idle switch 26 is on, that is, when the throttle valve 25 is in the idling position, the routine goes to step 100, and it is determined whether a fuel cut flag is set. As described hereinafter, when the fuel cut flag is set, the injection of fuel from the fuel injectors 172, 17*b*, is stopped. When the routine initially goes to step 100 after the decelerating operation of the engine is started, since the fuel out flag is in a reset state, the routine goes to step 101. In step 101, it is determined whether or not the engine speed N is higher than a predetermined engine speed A, for example, 1,600 r.p.m. When the engine speed N is higher than the predetermined engine speed A, the routine goes to step 103. Consequently, it is understood that the routine goes to step 103 when the decelerating operation of the engine is started in a state where the engine speed N is higher than the predetermined engine speed A. In step 103, the deceleration flag is set and, then, the routine goes to step 104. In step 104, it is determined whether or not a predetermined time period $\alpha$, for example, 500 msec has elapsed after the deceleration flag is set. When the predetermined time period $\alpha$ has not elapsed after the deceleration flag is set, the routine goes to step 105, and the shut-off valve 29 is controlled based on the output signal of the vacuum sensor 67 as illustrated in FIGS. 5 and 6. Contrary to this, when the predetermined time period $\alpha$ has elapsed after the deceleration flag is set, the routine goes to step 106, and the fuel cut flag is set. Then, in step 107, it is determined whether or not a predetermined time period $\beta$, for example, 500 msec has elapsed after the fuel cut flag is set. When the predetermined time period $\beta$ has not elapsed after the fuel cut flag is set, the routine goes to step 105. Contrary to this, when the predetermined time period $\beta$ has elapsed after the fuel cut flag is set, the routine goes to step 108, and the opening control of the shut-off valve 29 is carried out. This opening control is hereinafter described with reference to FIG. 6. If the opening control is started, first, the recirculation control valve 54 closes as illustrated in FIG. 6(*h*). After this, when the closing operation of the recirculation control valve 54 is completed, the opening operation of the shut-off valve 29 is started as illustrated in FIG. 6(*g*) and, at the same time, the assist air control valve apparatus 42 opens to the maximum extent as illustrated by the brocken line.

Turning to FIG. 8, when the idle switch 26 is turned off, that is, when the throttle valve 23 opens, the deceleration flag is reset in step 109 and, then, in step 110, the fuel cut flag is reset. In step 105, the shut-off valve 29 is controlled so that it is compulsorily caused to open when the engine speed N is reduced below a predetermined engine speed, for example 1,200 r.p.m. regardless of the output signal of the vacuum sensor 67. Consequently, in the case where the throttle valve 23 is opened when the decelerating operation is carried out, if the engine speed N is lower than 1,200 r.p.m., the shut-off valve 29 remains open. Contrary to this, in the case where the throttle valve 23 is opened when the decelerating operation is carried out, if the engine speed N is higher than 1,200 r.p.m., the shut-off valve 29 is controlled based on the output signal of the vacuum sensor 67.

On the other hand, in step 120 in FIG. 9, it is determined whether or not the fuel cut flag is set. When the fuel cut flag is in a reset state, the routine goes to step 121, and the injection of fuel is controlled based on the output signal of the vacuum sensor 67 as illustrated in FIGS. 5 and 6. Contrary to this, when the fuel cut flag is in a set state, the routine goes to step 122, and it is determined whether or not the engine speed N is higher than a predetermined engine speed B, for example, 1,400 r.p.m. When the engine speed N is higher than the predetermined engine speed B, the routine goes to step 123, and the injecting operation of all the fuel injectors 17*a*, 17*b* is stopped. However, if the engine speed N becomes lower than the predetermined engine speed B during the deceleration, the routine goes to step 121, and the injecting operation of the fuel injectors 17*a*, 17*b* is started.

According to the present invention, as mentioned above, if the decelerating operation of the engine is started when the engine speed N is higher than a predetermined engine speed A, the injection of fuel is stopped when the predetermined time period $\alpha$ has been elapsed after the decelerating operation is started. Then, the shut-off valve 29 is caused to open when the predetermined time period $\beta$ has elapsed after the injection of fuel is stopped. In the present invention, since the shut-off valve 29 opens when the engine is decelerated as mentioned above, both the first cylinder group A and the second cylinder group B are able to effect the engine braking operation and, thus, a good engine braking can be obtained. In addition, particularly in the case where the engine is operating under a light load, if the shut-off valve 29 opens when the depression of the accelerator pedal is temporarily released in order to change the gear position of the transmission, the shut-off valve 29 closes again when the accelerator pedal is depressed again. This result in a problem in that the output torque of the engine considerably fluctuates. In addition, if the injection of fuel is stopped when the depression of the accelerator pedal is temporarily released, a problem occurs in that the output torque of the engine also considerably fluctuates. Therefore, in the present invention, in order to eliminate such problems, the time lags $\alpha$ and $\beta$ are provided for the opening operation of the shut-off valve 29 and the stopping operation of the injection of fuel so that, when the depression of the accelerator pedal is temporarily released, the injection of fuel is not stopped and the shut-off valve 29 does not open. In addition, according to the present invention, when the engine speed N is reduced below the predetermined speed B after the decelerating operation of the engine is started, the injection of fuel is started again. At this time, if the shut-off valve 29 remains close due to the delay of the opening action thereof, since air is not fed into the first surge tank 11, a problem occurs in that a misfire occurs in the first cylinder group A. Therefore, in the present invention, when the decelerating operation of the engine is started, the assist air control valve apparatus 42 is caused to open as soon as the recirculation control valve 54 closes. As a result, even if the shut-off valve 26 remains close, since air is fed into the first pipes 13*a* of the first surge tank 11 from the first assist air conduit 37*a*, it is possible to prevent a misfire from occurring in the first cylinder group A.

While the invention has been described with reference to a specific embodiment chosen for the purpose of illustration, it is apparent that numerous modifications could be made thereto by those skilled in the art without departing from the basic concept and scope of the invention.

We claim:

1. A split engine having a plurality of cylinders which are divided into a first cylinder group and a second cylinder group, said engine comprising:

a first intake passage having an inlet and an outlet connected to said first cylinder group;

a second intake passage having an inlet and an outlet connected to said second cylinder group, the inlet of said first intake passage being connected to said second intake passage and the inlet of said second intake passage being open to the outside air;

an exhaust passage connected to said first cylinder group;

a manually operated throttle valve arranged in the inlet of said second intake passage;

first detecting means for detecting the level of the load of the engine and for producing an output signal representing the level of the load of the engine;

second detecting means for detecting the decelerating operation of the engine and for producing an output signal indicating that the decelerating operation is carried out;

electronic control means for producing control signals in response to the output signals of said first detecting means and said second detecting means;

fuel supply means, actuated in response to a control signal of said electronic control means, for feeding fuel into only said second cylinder group when the level of the load of the engine is lower than a predetermined level and for feeding fuel into both of said cylinder groups when the level of the load of the engine is higher than the predetermined level, said fuel supply means stopping the supply of fuel into both of said cylinder groups when a predetermined first time period has elapsed after the decelerating operation of the engine is started;

an exhaust-gas recirculation passage interconnecting said exhaust passage to said first intake passage;

a recirculation control valve, arranged in said exhaust-gas recirculation passage, for controlling the flow area of said exhaust-gas recirculation passage;

first actuating means operated in response to a control signal of said electronic control means and opening said recirculation control valve when the level of the load of the engine becomes lower than the predetermined level, said first actuating means closing said recirculation control valve independently of the level of the load of the engine when a predetermined second time period has elapsed after the decelerating operation of the engine is started;

a shut-off valve, arranged in the inlet of said first intake passage, for controlling the flow area of the inlet of said first intake passage; and second actuating means operated in response to a control signal of said electronic control means and opening said shut-off valve when the level of the load of the engine becomes higher than the predetermined level, said second actuating means opening said shut-off valve independently of the level of the load of the engine when the predetermined second time period has been elapsed after the decelerating operation of the engine is started.

2. A split engine according to claim 1, wherein said first time period is shorter than said second time period.

3. A split engine according to claim 2, wherein said first time period is about 500 msec, and said second time period is about 1,000 msec.

4. A split engine according to claim 1, wherein the engine comprises an engine speed sensor connected to said electronic control means and detecting the engine speed, the supply of fuel into both of said cylinder groups being stopped when the engine speed is higher than a predetermined first speed and when the decelerating operation of the engine is carried out, said shut-off valve opening when the engine speed is higher than a predetermined second speed and when the decelerating operation of the engine is carried out.

5. A split engine according to claim 4, wherein said first speed is lower than said second speed.

6. A split engine according to claim 5, wherein said first speed is about 1,400 r.p.m., and said second speed is about 1,600 r.p.m.

7. A split engine according to claim 1, wherein said second actuating means comprises a DC motor which is actuated by continuous pulses issued from said electronic control means.

8. A split engine according to claim 1, wherein said first actuating means comprises a valve position switch which is actuated in response to the movement of said recirculation control valve and which produces an output signal indicating that said recirculation control valve closes, said second actuating means actuating said shut-off valve in response to the output signal of said valve position switch for starting the operation of opening said shut-off valve after said recirculation control valve closes.

9. A split engine according to claim 8, wherein said first actuating means comprises a vacuum-operated diaphragm apparatus having a diaphragm, said valve position switch being operated in response to the movement of said diaphragm.

10. A split engine according to claim 1, wherein said second actuating means comprises a valve position sensor for detecting the position of said shut-off valve and for producing an output signal indicating that said shut-off valve closes, said first actuating means actuating said recirculation control valve in response to the output signal of said valve position sensor for starting the operation of opening said recirculation control valve after said shut-off valve closes.

11. A split engine according to claim 1, wherein said first detecting means is a vacuum sensor arranged in said second intake passage for detecting the level of vacuum in said second intake passage.

12. A split engine according to claim 1, wherein said second detecting means comprises an engine speed sensor, for detecting the engine speed, and an idle switch actuated in response to a change in the position of said throttle valve.

13. A split engine according to claim 1, wherein said fuel supply means comprises a first group of injectors arranged in said first intake passage and a second group of injectors arranged in said second intake passage.

14. A split engine according to claim 1, wherein the engine comprises a first assist air conduit having an outlet which is connected to said first intake passage, a second assist air conduit having an outlet which is connected to said second intake passage, and an assist air control valve arranged in said first assist air conduit and actuated in response to a control signal of said electronic control means for shutting off said first assist air conduit when said recirculation control valve is open, said first assist air conduit and said second assist air conduit having an inlet which is connected to the inlet of said second intake passage at a position located upstream of said throttle valve.

15. A split engine according to claim 14, wherein said second actuating means comprises a valve position sensor for detecting the position of said shut-off valve and for producing an output signal indicating that the closing operation of said shut-off valve is started, said assist air control valve shutting off said first assist air conduit when the closing operation of said shut-off valve is started.

16. A split engine according to claim 14, wherein said second actuating means comprising a valve position sensor for detecting the position of said shut-off valve and for producing separate two output signals indicating that the opening operation of said shut-off valve is started and completed, respectively, said assist air control valve opening independently of the level of the load of the engine when the decelerating operation of the engine is carried out and when the opening operation of said shut-off valve is started, said assist air control valve opening when the level of the load of the engine becomes higher than the predetermined level and when the opening operation of said shut-off valve is completed.

17. A split engine according to claim 14, wherein said assist air control valve comprises a vacuum-operated diaphragm apparatus.

18. A split engine according to claim 14, wherein the engine comprises an auxiliary air supply passage interconnecting the inlets of said first assist air conduit and said second assist air conduit to the inlet of said second intake passage, which inlet is located upstream of said throttle valve.

19. A split engine according to claim 18, wherein said auxiliary air supply passage has a control valve arranged therein for maintaining the engine speed at a predetermined speed at idle.

20. A split engine according to claim 14, wherein said fuel supply means comprises a plurality of first fuel injectors each having a nozzle, a plurality of second fuel injectors each having a nozzle, first assist air chambers surrounding the corresponding nozzles of said first fuel injectors and being open to said first intake passage, and second assist air chambers surrounding the corresponding nozzles of said second fuel injectors and being open to said second intake passage, the outlet of said first assist air conduit being connected to said first assist air chambers, the outlet of said second assist air conduit being connected to said second assist air chambers.

* * * * *